United States Patent [19]

Comparetti

[11] Patent Number: 4,910,812

[45] Date of Patent: Mar. 27, 1990

[54] SEMI-FLUSH VALVE MECHANISM

[76] Inventor: Joseph Comparetti, 23 Cedar Grove Ave., Lake Ronkonkoma, N.Y. 11779

[21] Appl. No.: 330,079

[22] Filed: Mar. 29, 1989

[51] Int. Cl.[4] ..... E03D 1/14

[52] U.S. Cl. ..... 4/325; 4/390; 4/393; 4/412; 4/415

[58] Field of Search ..... 4/324, 325, 345, 378, 4/390, 391, 392, 393, 405, 412, 415

[56] References Cited

U.S. PATENT DOCUMENTS

| | | | |
|---|---|---|---|
| 2,940,084 | 6/1960 | Fabbi et al. | 4/393 X |
| 3,003,156 | 10/1961 | Alexander | 4/393 X |
| 3,325,828 | 6/1967 | Alexander | 4/390 X |
| 3,419,912 | 1/1969 | Kertell | 4/405 X |
| 4,173,801 | 11/1979 | Bresnyan | 4/326 |
| 4,483,024 | 11/1984 | Troeh | 4/324 |
| 4,485,501 | 12/1984 | Kloner | 4/324 |
| 4,504,984 | 3/1985 | Burns | 4/326 |
| 4,620,331 | 11/1986 | Sagucio | 4/325 |

*Primary Examiner*—Henry J. Recla
*Assistant Examiner*—R. M. Fetsuga
*Attorney, Agent, or Firm*—Richard L. Miller

[57] ABSTRACT

A semi-flush valve mechanism in a toilet tank is provided with a two way flush operating handle. If the handle is pressed downward the toilet tank is flushed fully in the conventional way. If the handle is pressed upwardly the toilet tank is only half emptied in a semi-flush. A pivotally extended vane on a tilted valve assembly will receive a water stream from a refill tube to sooner help restore the toilet tank valve assembly to its closed upright position causing the semi-flush.

4 Claims, 1 Drawing Sheet

SEMI-FLUSH VALVE MECHANISM

BACKGROUND OF THE INVENTION

The instant invention relates generally to toilet flush valve systems and more specifically it relates to a semi-flush valve mechanism in a toilet tank.

Numerous toilet flush valve systems have been provided in the prior art that are adapted to regulate the volume of water discharged for flushing when evacuating toilet bowls. For example, U.S. Pat. Nos. 3,325,828 to Alexander; 4,483,024 Troeh; 4,504,984 to Burns; and 4,620,331 to Saguccio all are illustrative of such prior art. While these units may be suitable for the particular purpose to which they address, they would not be as suitable for the purpose of the present invention as hereafter described.

SUMMARY OF THE INVENTION

One of the biggest problems confronting the United States and the world today is water shortages due to overpopulation. Many attempts are being made to conserve water. One place where tremendous amounts of water are used and wasted is in the flushing of toilets. A number of water saver type toilet tanks have been introduced but one aspect of the problem seems to have been overlooked.

There is one of two possible conditions present when the toilet is flushed. When the existing condition is that the waste that needs to be flushed is only liquid, then less flush water is necessary. If it were possible to control the amount of water that is flushed into the bowl, say half a tank, that would save many gallons.

A primary object of the present invention is to provide a semi-flush valve mechanism that will overcome the shortcomings of the prior art devices.

Another object is to provide a semi-flush valve mechanism that includes a tank with a two way flush operating handle, such that if the handle is pressed downward the toilet is flushed fully in the conventional way, but if the handle is pressed in the upward direction, the tank is only half emptied.

An additional object is to provide a semi-flush valve mechanism that includes a pivotally adjustable vane on the valve assembly which will receive a water stream from a refill tube to sooner help restore the valve assembly to its closed upright position causing the semi-flush.

A further object is to provide a semi-flush valve mechanism that is simple and easy to use.

A still further object is to provide a semi-flush valve mechanism that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 3:
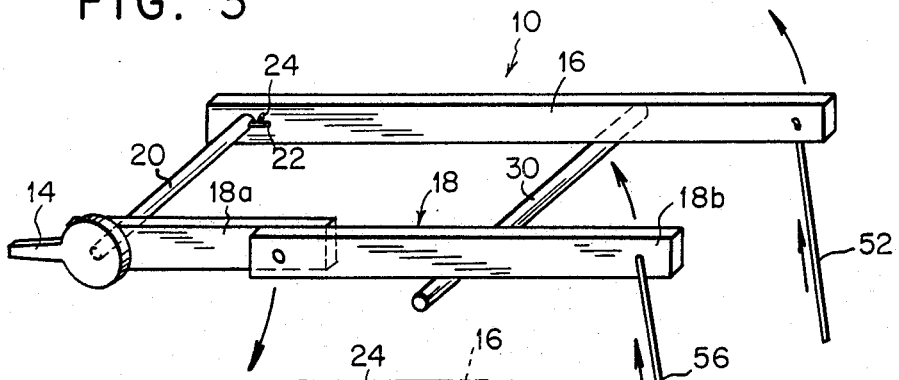
FIG. 3 is a diagrammatic perspective view of the control handle mechanism.

Turning now descriptively to the drawings, in which like reference characters denote like elements throughout the several views, the figures illustrate a semi-flush valve mechanism 10 for a toilet tank 12 which is an improvement over U.S. Pat. No. 3,325,828 entitled "Flow-Adjusting Tilting Flush Valve".

Figure 4:
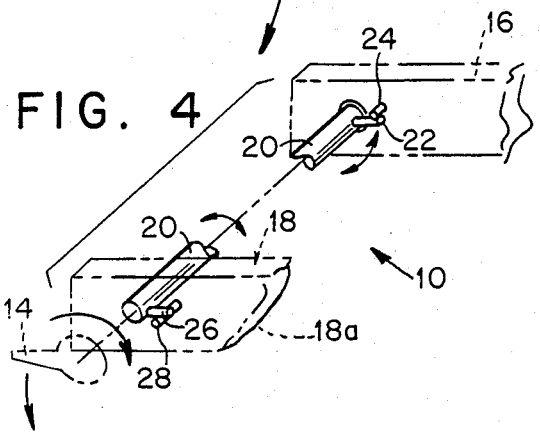
FIG. 4 is an enlarged similar view to that of FIG. 3 with parts broken away showing further construction details.

As shown in FIGS. 3 and 4, the mechanism 10 which is part of the instant invention includes a two way action of a handle 14 by replacing a single lift arm with two lift arms 16 and 18 on a shaft 20. Arm 16 can be rotated counter clockwise by a downward pressure on the handle 14 to cause a pin 22 on the shaft 20 to bear against a pin 24 on the arm 16 for an upward pull at the end of the arm 16 which will cause the conventional full flush. Arm 18 is not affected during counter clockwise rotation of the operating handle 14 because there is a pin 26 on the shaft 20 that only bears against a pin 28 on arm 18 during a clockwise rotation.

Arm 18 is pivoted when it is activated by an upward clockwise pressure on the handle 14. The handle rotating clockwise rotates a short section **18*a* of the lift arm 18 downward which in turn causes a long section 18*b* to bear against rest number (30) and rotate counter clockwise. Arm 16 is not affected during clockwise rotation of the operating handle 14**.

Figure 1:
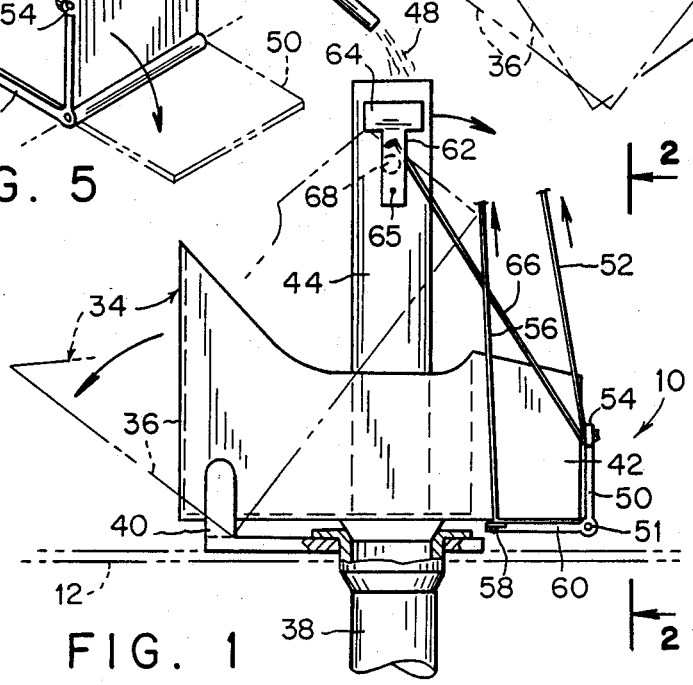
FIG. 1 is a diagrammatic side elevational view of the instant invention with parts broken away.
Figure 2:
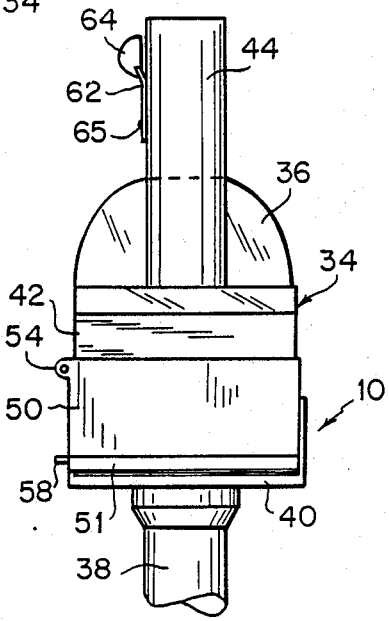
FIG. 2 is a diagrammatic elevational view taken along line 2—2 of FIG. 1.

In reference to FIGS. 1 and 2, the upward action of either arm 16 and 18 will determine whether tilting valve assembly 34 will allow full or semi emptying of the tank 12. Housing 36 of the valve assembly 34 is secured to a flush port 38 using a pivot bracket 40. When arm 16 is actuated the entire valve assembly 34 will tilt back on the pivot bracket 40 and allow the water to rush through the port 38 until the water level lowers to a point where the buoyancy of the water no longer holds the float chamber 42 and assembly 34 in an open tilted position and returns it to a closed upright position thereby shutting off escaping water to fully empty the tank 12.

The valve assembly 34 also includes an overflow tube 44. A water refill tube 46 is located just above the overflow tube and produces a water stream 48. When the valve assembly 34 is in a vertical position the water stream 48 will enter the overflow tube 44 and refill the bowl trap as the tank 12 refills. When the valve assembly 34 is tilted the water stream 48 from the refill tube 46 will bypass the housing 36 but be in close proximity thereto (as best seen in FIG. 6).

The mechanism 10 also contains a vane 50 pivotally attached at 51 to housing 36 which can have two positions, extended and retracted. The position the vane 50 takes is determined by the direction in which the operating handle 14 is rotated. If the handle is pressed downward (counter clockwise) the arm 16 is raised. Arm 16 is connected by a first flexible lanyard 52 to the vane 50 at first eyelet 54 causing the vane 50 to retract while valve assembly 34 is being tilted. If the operating handle 14 is pressed upward (clockwise) arm **18*b* is raised. Arm 18*b* is connected via a second flexible lanyard 56 second eyelet 58 on lever 60 extending at right angle from pivot 51 causing the vane 50 to extend while the valve assembly 34** is being tilted.

Figure 6:
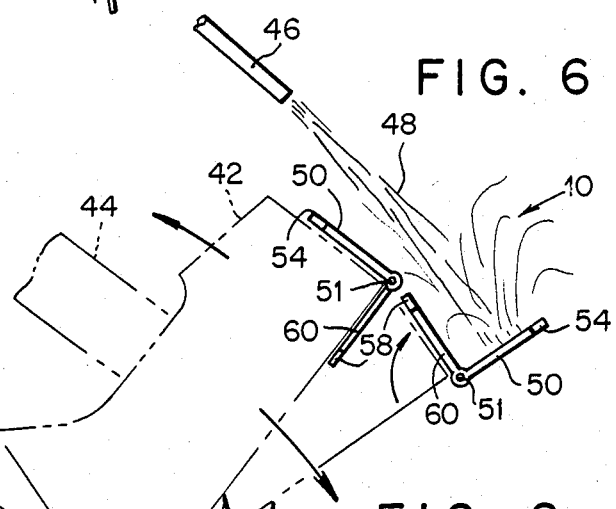
FIG. 6 is a diagrammatic view similar to FIG. 1 illustrating how the structure tips.
Figure 5:
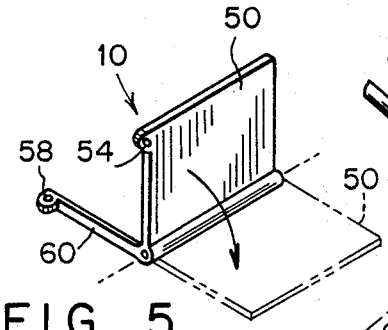
FIG. 5 is a perspective view of a vane component per se.

As seen in FIG. 6, when the vane 50 is retracted the water stream 48 from the refill tube 46 has no effect on the valve assembly 34, but when the vane 50 is extended the water stream 48 will strike the vane 50 and apply pressure thereto tending to restore the valve assembly 34 to its closed upright position. This causes the valve assembly 34 to close sooner thereby only allowing the semi-flush and saving about a gallon of water for each flush.

One other condition must be satisfied before the mechanism 10 will work efficiently. During the semi-flush cycle the refill time is shortened. As a result the bowl trap doesn't refill to its normal level. This adversely effects the next flush cycle. To offset this problem it is necessary to add additional corrective mechanism to the overflow tube 44.

As shown in the FIGS. 1 and 2, a leg 62 with a float 64 is pivotally attached at 65 to the side of the overflow tube 44 in such a way as to seal off an aperture 68 in the tube only while the float 64 is in the vertical position. The leg 62 is connected by a third flexible lanyard 66 to eyelet 54 on the vane 50. When the vane is extended by pushing the operating handle 14 up, (as shown in FIGS. 3 and 4) this leg 62 is simultaneously pulled forward by the third flexible lanyard 66. The aperture 68 in the overflow tube 44 will be opened and more water will be allowed to enter the bowl trap during the semi-flush cycle. The aperture 68 in the overflow tube 44 is again closed when the float 64 on the leg 62 causes it to return to the vertical position by the buoyancy of the returning water level in the tank 12. During the full flush cycle the leg 62 remains in the vertical position.

The amount of water that is allowed to flush during the semi-flush cycle may be adjusted either by having stops at various points along the movement of the vane 50 to lessen or increase the pressure of the water stream 48, or varying the pressure of the water stream 48 from the refill tube 46 from higher to lower by means of an adjusting screw (not shown) on the tube 46.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A semi-flush valve mechanism adapted for use in a toilet tank that includes a refill tube for providing sealing water and a tilting valve assembly of the type having a housing defining a reservoir chamber, a pivot bracket connecting the housing a port to the tank and providing communication between the tank and reservoir chamber, and an overflow tube, said valve mechanism comprising:

(a) a vane adapted to be pivotally hinged to a side of the housing so that said vane can be pivoted into an extended position and a retracted position;

(b) a first means operating handle adapted to be pivotally mounted to the toilet tank so that said handle can rotate clockwise and counterclockwise;

(c) a first means coupled to said handle for lifting the valve assembly to an open tilted position and for keeping said vane in the retracted position when said handle is rotated counter clockwise causing a conventional full flush cycle in the tank; and (d) means coupled to said handle for lifting the valve assembly to the open tilted position and for simultaneously moving said vane to the extended position when said handle is rotated clockwise allowing a water stream from the refill tube to strike said vane and apply pressure thereto tending to restore the valve assembly to a closed upright position sooner causing a semi-flush cycle in the tank.

2. A semi flush valve mechanism as recited in claim 1, wherein said first means includes:

(a) a first lift arm coupled to said handle so that said first lift arm will be lifted in a counter clockwise direction only when said handle is rotated counter clockwise; and (b) a first flexible lanyard connected between an end of said first lift arm and said vane so that said vane will be kept in the retracted position when the valve assembly is being tilted in the open position when said handle is rotated counter clockwise.

3. A semi-flush valve mechanism as recited in claim 2, wherein said second means includes:

(a) a rest member adapted to be mounted to the tank;

(b) a second lift arm having a short section coupled to said handle and pivotally connected to a first end of a long section so that when said handle is rotated clockwise it will rotate said short section clockwise which in turn causes said long section to bear against said rest member at a point along said long section spaced from said first end and thus rotate about the pivot creating an upward counter clockwise pull at a free end of said long section;

(c) a lever connected at a right angle to said hinge on said vane; and (d) a second flexible lanyard connected between the free end of said long section of said second lift arm and said lever so that said vane will be simultaneously moved to the extended position while the valve assembly is being tilted into the open position when said handle is rotated clockwise.

4. A semi-flush valve mechanism as recited in claim 3, further comprising:

(a) an aperture adapted to extend through a side of the overflow tube;

(b) a leg with a float adapted to be pivotally-attached to side of the overflow tube to seal off said aperture only when said overflow tube is in a vertical position; and (c) a third flexible lanyard connected between said leg and said vane so that when said vane is moved to the extended position said leg will be simultaneously pulled forward by said third flexible lanyard so as to expose said aperture to allow more water to enter the port providing additional sealing water during the semi-flush cycle, whereby said aperture will be sealed when said float returns to its vertical position by the returning water level in the tank.

* * * * *